US005848505A

United States Patent [19]

Taylor

[11] Patent Number: 5,848,505

[45] Date of Patent: Dec. 15, 1998

[54] OUTDOOR WINDOW SHUTTER

[76] Inventor: Barry Woodrow Taylor, #5 Brigadoon Pl., Charleston, S.C. 29414

[21] Appl. No.: 857,879

[22] Filed: May 16, 1997

[51] Int. Cl.[6] ..... E06B 3/26

[52] U.S. Cl. ..... 52/202; 52/203; 52/314

[58] Field of Search ..... 52/202, 203, 473, 52/314, 478; 49/371, 74

[56] References Cited

U.S. PATENT DOCUMENTS

| | | | |
|---|---|---|---|
| 4,248,022 | 2/1981 | Walker | 52/473 |
| 4,858,400 | 8/1989 | Foyt | 52/473 X |
| 5,152,116 | 10/1992 | MacGowan | 52/202 X |
| 5,237,785 | 8/1993 | Lukes | 52/202 X |
| 5,255,486 | 10/1993 | Wang | 25/473 |

*Primary Examiner*—Carl D. Friedman
*Assistant Examiner*—W. Glenn Edwards
*Attorney, Agent, or Firm*—Harleston Law Firm; Kathleen M. Harleston

[57] ABSTRACT

A surprisingly durable, strong, outdoor window shutter without functional louvers or slats, which is substantially comprised of polyvinyl chloride, is described. The shutter preferably has a center panel onto which is laminated two back vertical members. This is preferably in the shape of a rectangle with two opposite edges into which stepped projections have been cut. The shutter preferably also has two vertical side members, each having a channel containing a strengthening rod. The vertical side members have stepped arms which fit closely over the stepped projections. Mortise and tenon joints are formed at the point of connection between the stepped projections and the stepped arms. The strengthening rods and the mortise and tenon joints serve to strengthen the shutter. Additional strength is provided by horizontal members affixed to the top, middle and bottom of both the front and the back of the shutter. These shutters have excellent structural rigidity and can last for many years.

9 Claims, 2 Drawing Sheets

FIG. 1
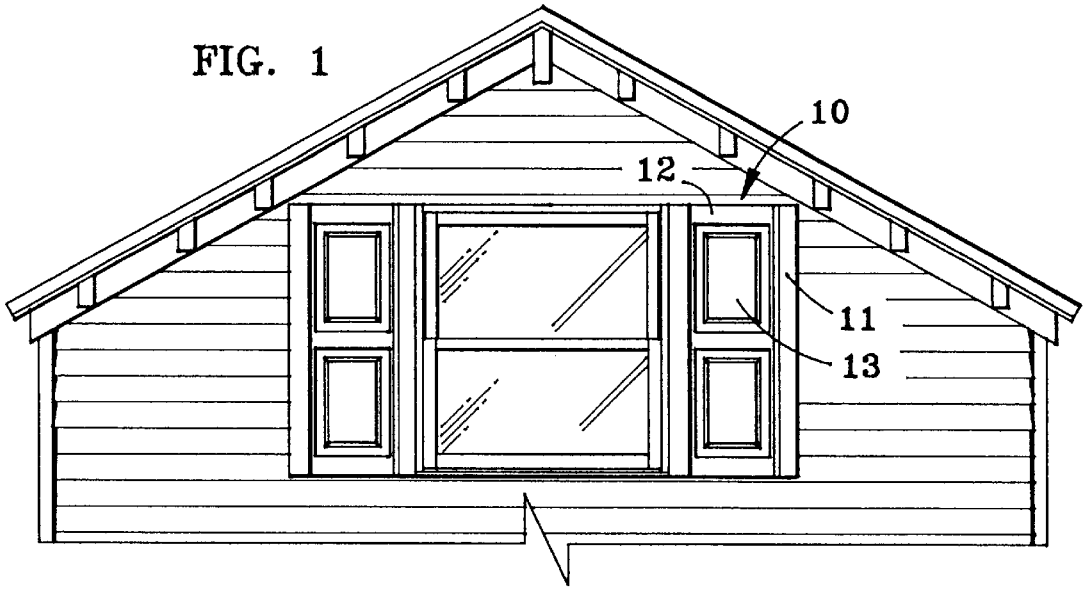
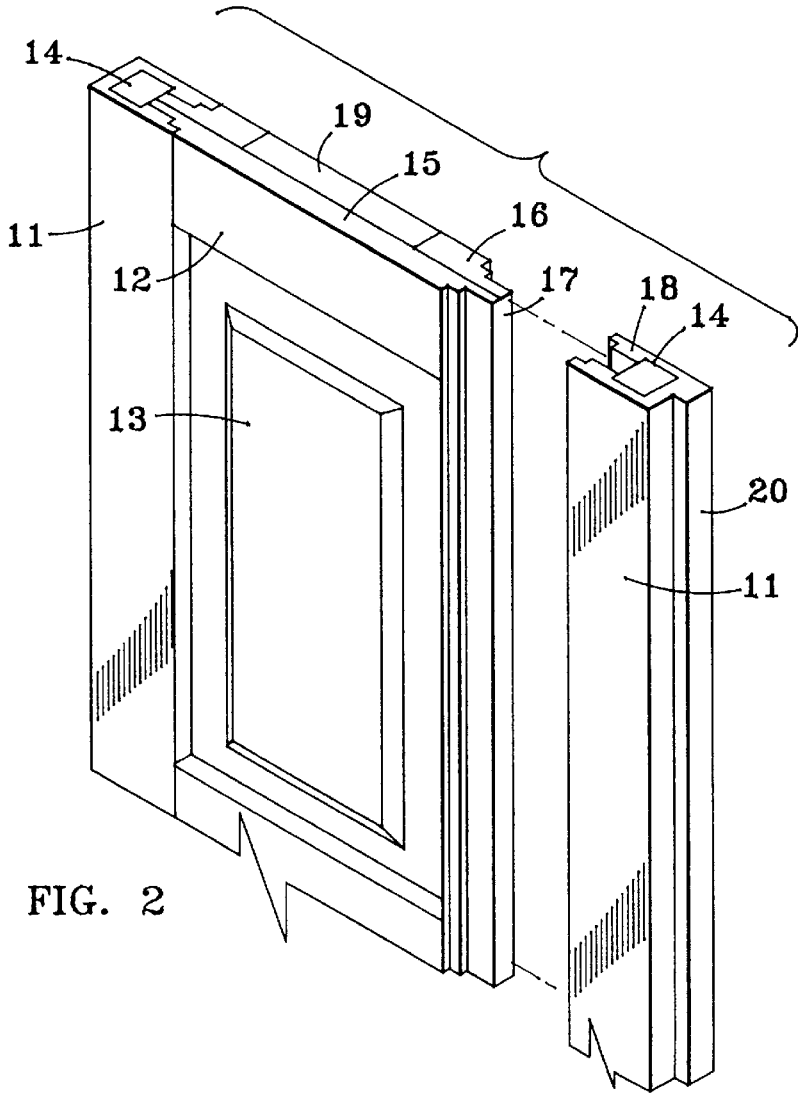
FIG. 2

OUTDOOR WINDOW SHUTTER

BACKGROUND OF THE INVENTION

1. Technical Field

The present invention relates to shutters which are for use outdoors and which are substantially comprised of polyvinyl chloride. More particularly, the present invention relates to durable, outdoor window shutters without functional louvers or slats which are made of polyvinyl chloride.

2. Background Art

Wooden shutters likely antedate the United States patent system. One problem with wooden window shutters, though, is that they wear out. Wooden shutters, particularly when they are used outdoors, tend to expand and contract with the weather, absorb liquid, and show signs of wear and tear. They are not fire-safe. Their measurements can change with storage or during shipment to their destination. The manufacture of wooden shutters involves cutting trees, and is likely to generate waste.

Polyvinyl chloride shutters, on the other hand, are particularly suited for use outdoors. Unlike wooden shutters, they have excellent structural rigidity, and they do not expand or contract or warp or absorb liquid. They are good insulators and do not support fire, and they are relatively resistant to wear and tear. Also, the manufacture of polyvinyl chloride shutters does not involve tree-cutting, and they can be recycled. During manufacture, the polyvinyl chloride generally can be cut or extruded into many shapes, is forgiving to carbide tipped tools, and generates little waste. Polyvinyl chloride shutters can easily be cut to the size required for a window opening and the measurements do not change with storage or during shipment.

SUMMARY OF THE INVENTION

The present invention provides a surprisingly durable, strong, outdoor window shutter without functional louvers or slats, which is substantially comprised of polyvinyl chloride. The preferred embodiment comprises a center panel onto which is laminated two back vertical members. This is preferably in the shape of a rectangle with two opposite edges which have stepped projections. The preferred embodiment further comprises two vertical side members, each comprising a channel which comprises a strengthening rod, preferably a square, hollow aluminum rod. The vertical side members further comprise stepped arms which fit closely over the stepped projections. Mortise and tenon joints are formed at the point of connection between the stepped projections and the stepped arms. The aluminum rods and the mortise and tenon joints further strengthen the shutter. Additional strength is provided by horizontal members affixed to the top, middle and bottom of both the front and the back of the shutter. These shutters have excellent structural rigidity and can last for many years.

BRIEF DESCRIPTION OF THE DRAWINGS

A more complete understanding of the invention and its advantages will be apparent from the following Description of the Preferred Embodiment(s) taken in conjunction with the accompanying drawings, wherein:

FIG. 1 shows a perspective view of two outdoor window shutters constructed in accordance with the present invention;

FIG. 2 shows a perspective view of the top portion of a window shutter constructed in accordance with the present invention;

DESCRIPTION OF THE PREFERRED EMBODIMENTS

Figure 4:
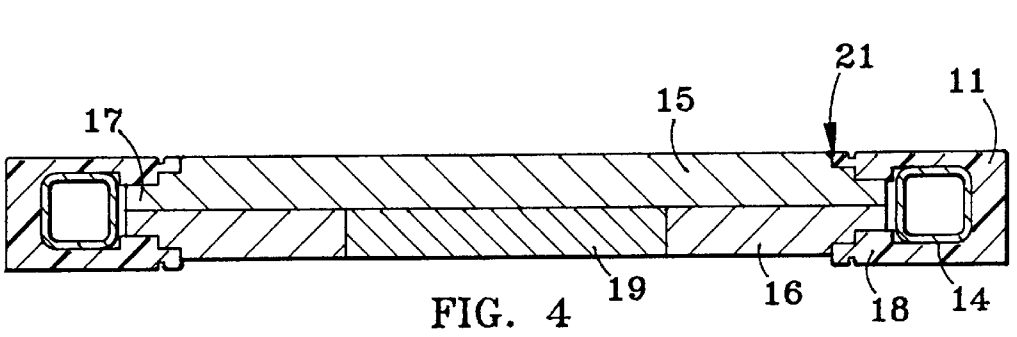
FIG. 4 shows a horizontal cross-sectional view of the shutter shown in FIG. 3, which is taken along the line 4—4.

In the following description, like reference characters designate like or corresponding parts throughout the several views. Also, in the following description, it is to be understood that such terms as "right", "left", "inside", "outside", and the like are words of convenience and are not to be construed as limiting terms. Referring in more detail to the drawings, the invention will now be described.

There is illustrated in FIG. 1 a perspective view of two outdoor window shutters, which are constructed in accordance with the present invention. The shutters are virtually identical except for their attachments on opposite sides to the window frame of the building seen in the figure. The shutter of the present invention is generally designated 10. A shutter 10 in FIG. 1 has two raised panels 13, two vertical side members 11, and three front horizontal members 12. The vertical side members 11, also called "stiles", are the parts of the shutter which run lengthwise along the sides of the shutter. The horizontal members 12, also called "rails", are the parts of the shutter which run crosswise in between the vertical side members 11 or stiles.

FIG. 2 shows a perspective view of the top half of a window shutter constructed in accordance with the present invention. FIG. 2 shows the raised panel 13, the two vertical side members 11 running lengthwise, and the top front horizontal member 12, which runs crosswise. The vertical side member 11 on one side of the shutter is shown separated from the rest of the shutter to better illustrate the construction of the shutter. On a completed shutter, both vertical side members are affixed. The top of the shutter is also shown in FIG. 2 to illustrate the shutter's construction.

The construction of a preferred window shutter embodiment is as follows. First, a solid slab of polyvinyl chloride (PVC) extrusion is cut to size according to the specifications of the window to be shuttered. This is the center panel 15, as shown in FIG. 2. Included in the term "polyvinyl chloride" are chemical variants thereof. Raised panels 13 are routed into the custom cut polyvinyl chloride center panel 15 using a series of routers.

Next, two vertical members made of polyvinyl chloride are glued onto the back of center panel 15 at the location indicated in FIG. 2. These back vertical members 16 are of approximately the same thickness as the center panel 15, and are approximately the same width and length as the vertical side members 11. Any suitable adhesive which works on polyvinyl chloride can be employed. Thirdly, two stepped projections 17 are cut into the two long edges of the center piece made by laminating the back vertical members 16 onto the center panel 15. These are shown in FIG. 2.

Figure 3:
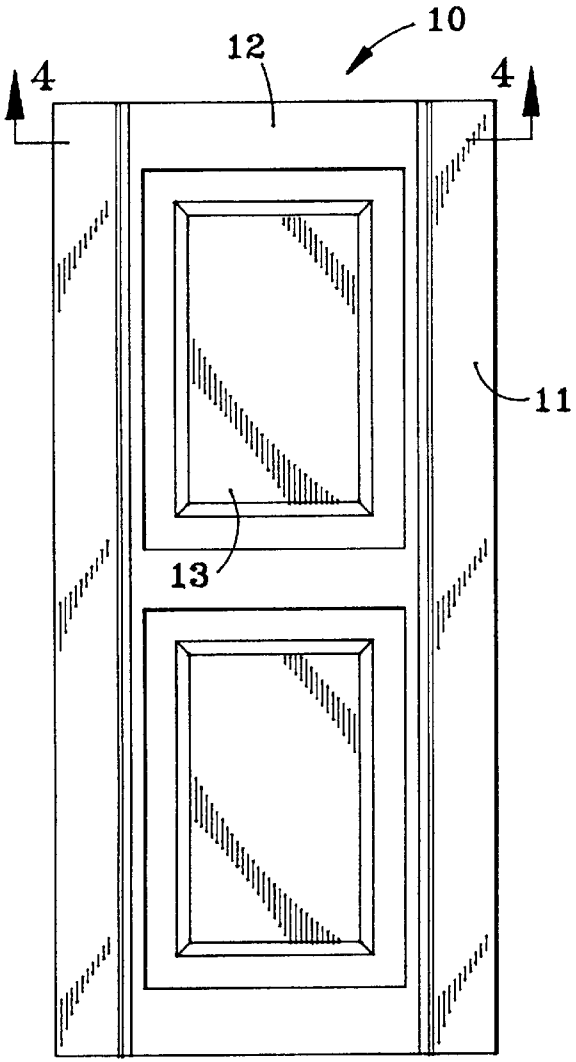
FIG. 3 shows a perspective view of an alternative embodiment of a shutter constructed in accordance with the present invention.

FIG. 3 shows a front view of another embodiment of a completed shutter. Two matching vertical side members 11, three front horizontal members 12, and two raised panels 13 are shown.

FIG. 4 shows a horizontal cross-sectional view of the shutter shown in FIG. 3, which is taken along the line 4—4.

Figure 6:
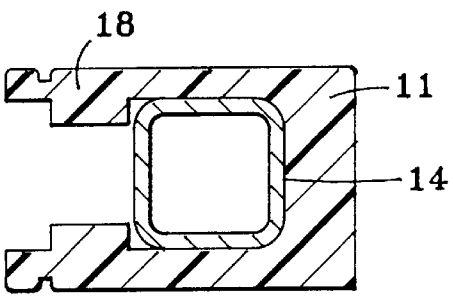
FIG. 6 shows another detail view from the FIG. 4 horizontal cross-section.
Figure 5:
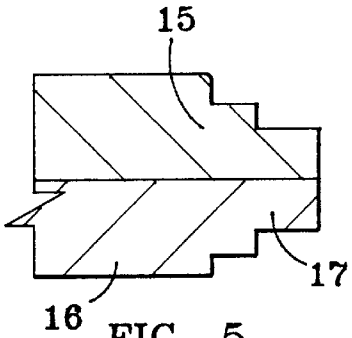
FIG. 5 shows a detail view from the FIG. 4 horizontal cross-section.

FIG. 5 shows a detail view from the right end of the FIG. 4 cross-sectional view. A stepped projection 17 is shown in FIG. 5. FIG. 6 also shows a detail from the right end of the FIG. 4 cross-sectional view. Specifically, FIG. 6 shows the vertical side member 11 from the right end of the shutter. These are explained further in the following.

To continue with the description of the steps followed in constructing a shutter 10, two vertical side members 11 have been extruded of polyvinyl chloride. This is done in a step separate from the panel construction steps described above. A square-shaped channel has been extruded in each vertical side member 11 to accommodate an aluminum rod 14. The aluminum "rod" is preferably a right angle (approximately 90 degrees) aluminum ell, or alternatively a square, hollow aluminum rod. In a fifth construction step, the two aluminum rods 14 are inserted into the channels in the vertical side members 11. These rods run approximately the length of the shutter on either side and serve to strengthen the shutter. The ends of the channels are closed with small, thin, square cut-outs of polyvinyl chloride or other suitable material. The small cut-outs are about the same size as the channel and serve to conceal the ends of the aluminum rods when the shutter is viewed from the top. The cut-outs are affixed using a suitable, commercially available adhesive. The rods are thus not removable and are not taken in and out of the channels during shutter use.

As shown in FIG. 6, each vertical side member 11 has two arms 18, which extend the length of the vertical side members 11. These stepped arms 18 are made to grip the complementary stepped projection 17 which is shown in FIG. 5. The steps in the arms 18 match the steps on the projection 17. Thus, FIG. 5 shows the male projection 17 and FIG. 6 shows the female complementary arms 18 of the vertical side members 11. The point of attachment between them is called a mortise and tenon joint 21, which can be seen in FIG. 4.

In a seventh construction step, the vertical side member 11 is slid down onto the projection 17 on the edge of the center piece creating a mortise and tenon joints 21. This is repeated on the other side with the other vertical side member 11 and the other projection 17. The mortise and tenon joints 21 allow a sturdy fit between the vertical side members 11, which now contain the aluminum rods 14, and the center piece of the shutter. A cross-section of the completed product can be seen in FIG. 4. The mortise and tenon joints 21 further strengthen the shutter. Various commercially available adhesives which are suitable for use on polyvinyl chloride are used to seal the mortise and tenon joints 21.

In the last step of construction, three horizontal members are affixed to the back of the shutter to increase its strength. These back horizontal members 19 fit between the back vertical members 16 and are located at approximately the top, middle and bottom of the back of the shutter. A back horizontal member 19 can be seen at the top of the shutter 10 in FIGS. 2 and 4. The back of the shutter is the side which is preferably placed toward the wall when the shutter is mounted at or near the edge of the outside window frame on the residential or commercial building.

In summary, this is a strong, durable outdoor window shutter without functional louvers or slats, which is substantially comprised of polyvinyl chloride. The shutter of the present invention does not have, for example, a plurality of louvers or slats or strips positioned between support members. The shutter of the present invention preferably further comprises: a) one or more non-removable strengthening rods such as aluminum rods 14; b) two vertical side members 11 made of polyvinyl chloride; each vertical side member 11 comprising a channel which comprises an aluminum rod 14 for strengthening the shutter; and/or c) two back vertical members 16 laminated onto a center panel 15; the back vertical members 16 extending the length of the center panel 15. Further, the laminated center panel 15 and back vertical members 16 are in the shape of a rectangle with two opposite edges which have stepped projections 17. Shutters are ordinarily rectangular, and the stepped projections 17 are on the long sides of the rectangle. The short sides of the rectangle are the top and bottom of the shutter. The vertical side members 11 preferably further comprise stepped arms 18 which fit closely over the stepped projections 17. Two mortise and tenon joints 21 are formed by the connection of the two vertical side members 11 to the two stepped projections 17.

The shutter preferably further comprises: a) three horizontal members 12 affixed to the top, middle and bottom of the front of the shutter; the ends of the horizontal members 12 contacting the vertical side members 11; and/or b) three horizontal members 19 affixed to the back of the shutter; the horizontal members 19 being located at approximately the top, middle and bottom of the back of the shutter; and the ends of the horizontal members 19 contacting the back vertical members 16. The center panel 15 preferably comprises one or more raised panels 13.

The shutter 10 is especially suited for use on the outside of a building, where its strength and durability are of value. It is preferred for use on the exterior windows of a residential or commercial building. It is preferred for use as a decorative shutter or as a functional hurricane shutter.

To mount the shutter, conventional hinge mechanisms may be attached to the outside face of one side of the shutter of the present invention. The holes for the hinges can be drilled in the vertical side members 11 during construction. The shutter 10 can be attached to the frame of a window opening, or to the wall of the building in close proximity to the window. Screws or bolts can be used to attach the hinges to the window frame or wall. The location of attachment of the shutter varies depending upon whether it is a functional or solely decorative shutter. Preferably, two nearly identical shutters are mounted side by side to cover the expanse of the window being protected.

The present shutter works well as a hurricane shutter. A preferred embodiment is a set of matched hurricane shutters which can be closed over the window and latched in case of inclement weather or for security reasons. The shutters in a set are generally identical except that they have adjoining complementary faces. One shutter preferably has a rabbet edge 20 which projects over the complementary rabbet edge of the other shutter. Thus, the rabbet edge 20 would be on the left edge of one shutter and the right edge of the other shutter in the pair. When the shutters are closed over the window, the rabbet edges contact and the shutters are preferably latched. The shutters can be used on residential or commercial buildings. When closed, they protect against strong winds and foreign object impact caused by, for example, storms, hurricanes, typhoons, or sand storms. They can be closed over windows on a vacant building, for example, to make breaking and entering more difficult. While FIG. 2 has a rabbet edge and is suitable for use as a hurricane shutter, the shutter of FIG. 3 has a straight edge rather than a rabbet edge and would be more suitable for use as a decorative outdoor shutter which does not close over the window.

Conventional hinge mechanisms should be attached to the opposite outside faces of the sides of each hurricane shutter.

One or more closure mechanisms can be attached to the inside faces of the hurricane shutters so that they can be closed over the window. There is ordinarily one closure mechanism, placed so that the shutters can be closed from the inside of the residence or other type of building.

The shutter of the present invention is nonwooden, meaning that it is not made of any substantial amounts of wood. Preferably, less than about 8%, more preferably less than about 4%, most preferably less than about 1%, by weight of the shutter, is comprised of wood or a wood-based product.

The shutters of the present invention are substantially comprised of polyvinyl chloride. This plastic is very long lasting and durable. The present shutter is preferably comprised of more than about 60%, more preferably more than about 70%, most preferably more than about 80%, by weight of polyvinyl chloride.

The shutters of the present invention outlast comparable shutters made of wood. Polyvinyl chloride shutters in general do not require repainting as often as wooden shutters, although they should be repainted periodically during the life of the shutter. Polyvinyl chloride shutters have good structural rigidity, are resistant to wear and tear, and do not shrink or expand or warp. They can be custom cut to match various window sizes. When these advantages are combined with the added strength conveyed by the channel-cut vertical side members with strengthening rods, and the mortise and tenon joints between the vertical side members and the center panel, the result is a very durable, strong shutter.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

BRIEF LIST OF REFERENCE NUMERALS USED IN THE DRAWINGS

| | |
|---|---|
| 10 | window shutter |
| 11 | vertical side member |
| 12 | front horizontal member |
| 13 | raised panel |
| 14 | aluminum rod |
| 15 | center panel |
| 16 | back vertical member |
| 17 | projection |
| 18 | arm |
| 19 | back horizontal member |
| 20 | rabbet edge |
| 21 | mortise and tenon joint |

What is claimed is:

1. A strong, durable outdoor window shutter without functional louvers or slats; the shutter being substantially comprised of polyvinyl chloride and comprising:

two vertical side members each comprising a channel;

a non-removable aluminum rod within each of the channels in the two vertical side members;

a center panel between the two vertical side members;

two back vertical members attached onto the back of the center panel to form a laminated center panel; the back vertical members extending the length of the center panel; and the center panel and back vertical members having two opposite edges, each edge comprising stepped projections; and wherein the vertical side members further comprise stepped arms which fit closely over the stepped projections; and wherein two mortise and tenon joints are formed by the connection of the two vertical side members to the two stepped projections.

2. The shutter according to claim 1, wherein the laminated center panel and back vertical members are in the shape of a rectangle with two opposite edges; the opposite edges having stepped projections.

3. The shutter according to claim 2, further comprising three horizontal members affixed to the top, middle and bottom of the front of the shutter; the ends of the horizontal members contacting the vertical side members.

4. The shutter according to claim 1, further comprising three horizontal members affixed to the back of the shutter; the horizontal members being located at approximately the top, middle and bottom of the back of the shutter; and the ends of the horizontal members contacting the back vertical members.

5. The shutter according to claim 4, wherein the center panel comprises one or more raised panels.

6. The shutter according to claim 5, which is one of a pair of matched shutters which can be closed over the window and latched in case of inclement weather.

7. The shutter according to claim 5 for use as a functional hurricane shutter.

8. The shutter according to claim 7, wherein each vertical side member comprises an aluminum ell.

9. The shutter according to claim 8, more than about 80% by weight of which is comprised of polyvinyl chloride.

* * * * *